US007963521B2

(12) United States Patent
Dinnissen

(10) Patent No.: US 7,963,521 B2
(45) Date of Patent: Jun. 21, 2011

(54) SHEET FLIPPING DEVICE

(75) Inventor: Johannes H. A. Dinnissen, Venlo (NL)

(73) Assignee: OCE-Technologies B.V., Venlo (NL)

( * ) Notice: Subject to any disclaimer, the term of this patent is extended or adjusted under 35 U.S.C. 154(b) by 111 days.

(21) Appl. No.: 11/987,417

(22) Filed: Nov. 29, 2007

(65) Prior Publication Data

US 2008/0136088 A1 Jun. 12, 2008

(30) Foreign Application Priority Data

Dec. 1, 2006 (EP) ..... 06125206
Dec. 14, 2006 (EP) ..... 06126132

(51) Int. Cl.
*B65H 29/00* (2006.01)

(52) U.S. Cl. ..... 271/187; 271/315; 271/208

(58) Field of Classification Search ..... 271/65, 271/187, 315, 208
See application file for complete search history.

(56) References Cited

U.S. PATENT DOCUMENTS

| | | | | |
|---|---|---|---|---|
| 4,501,418 | A | 2/1985 | Ariga et al. | |
| 5,400,208 | A * | 3/1995 | Pazda et al. | 361/221 |
| 5,740,006 | A * | 4/1998 | Larkin | 361/213 |
| 6,536,761 | B2 * | 3/2003 | Mochizuki et al. | 271/208 |
| 2008/0029952 | A1 * | 2/2008 | Major | 271/207 |

FOREIGN PATENT DOCUMENTS

| | | | |
|---|---|---|---|
| FR | 2760633 | A1 | 9/1998 |
| JP | 57145765 | A | 9/1982 |
| JP | 62218356 | A * | 9/1987 |

* cited by examiner

*Primary Examiner* — Michael C McCullough
(74) *Attorney, Agent, or Firm* — Birch, Stewart, Kolasch & Birch, LLP

(57) ABSTRACT

A sheet flipping device including a receiving member for receiving a sheet, a flipping volume defined by the flipping movement of the sheet when in operation, a flipping element for flipping the sheet around an axis of rotation within the flipping volume onto the receiving member, and a discharge element arranged adjacent to said flipping volume, the discharge element having a base extending in a direction substantially perpendicular to the direction of the axis of rotation and having multiple electrodes with an end portion extending in a direction towards the flipping volume. The sheet flipping device is useable in a sheet stacking device and an image reproduction apparatus.

17 Claims, 5 Drawing Sheets

SHEET FLIPPING DEVICE

This application claims priority from European Patent Applications No. 06125206.0 filed on Dec. 1, 2006 and No. 06126132.7 filed on Dec. 14, 2006, the entire contents of each being hereby incorporated by reference.

The present invention relates to a sheet flipping device, comprising a receiving member for receiving a sheet, a flipping volume being the volume which, in operation, is defined by the flipping movement of the sheet, and a flipping element for flipping the sheet around an axis of rotation within the flipping volume onto the receiving member. The present invention also relates to a sheet stacking device and an image reproduction apparatus which utilizes the sheet flipping device.

A device of this kind is described in FR 2 760 733. The device uses a flipping wheel to stack sheets on a receiving member in a flipped orientation. The flipping wheel comprises slits at its circumference to accommodate portions of a sheet. An abutment is provided to release the sheets from the slit onto the receiving member. However, it is a disadvantage of this known device that certain types of sheets, in particular floppy sheets with low stiffness in the direction of rotation, do not roll out correctly onto the receiving member, resulting in a less orderly stack or even a device which becomes blocked because of paper jams.

SUMMARY OF THE INVENTION

It is an object of the present invention to improve the roll out of sheets onto the receiving member for flipping devices. To this end a sheet flipping device is provided which comprises a discharge element arranged adjacent to said flipping volume, having a base extending in a direction substantially perpendicular to the direction of the axis of rotation said discharge element having multiple electrodes having an end portion extending in a direction towards the flipping volume.

It is observed that the implementation of such a discharge element, which is arranged adjacent to the flipping volume, surprisingly increases the reliability of the flipping device as a result of better roll out of flipped sheets. Even without any physical contact between the discharge elements and the flipping sheets, the roll out of sheets, even of very floppy sheets, improves significantly.

In another embodiment of the device according to the present invention the multiple electrodes each have a sharp end pointing towards the flipping volume. It has been observed that sharp endings which point towards the flipping volume further increase the reliability of the sheet flipping device by further decreasing the risk of an erroneous roll out of a flipping sheet.

In a further embodiment of the device according to the present invention, the multiple electrodes each have a top angle of less than 30°. It has been found that a top angle of less than 30° is sharp enough for situations in devices as presently presented, i.e., existing materials and occurring distances to sufficiently overcome roll out problems. It is preferred to implement top angles of 15° or less.

In another embodiment of the device according to the present invention, the discharge element is electrically connected to earth potential. It has been observed that a connection to earth of the discharge element reduces the risk of collapsing sheets during roll out after or during flipping.

In another embodiment of the device according to the present invention, the multiple electrodes comprise pin-electrodes. Pin-electrodes are usually relatively stiff with respect to flipping sheets. Discharge elements that are provided with pin-electrodes adjacent to the flipping volume have a positive influence on the reliability of the flipping device. The construction of pin-electrodes can be cost-efficient as they may be constructed from a single workpiece by milling, e.g., stainless steel or any other electrically conductive material or material with an electrically conductive surface.

In an embodiment of the device according to the present invention, each of said multiple electrodes comprise a fiber organ provided with a conductive outer surface. The fibre organ provides a flexible base for the electrically conductive outer surface. The fibre does not need to be electrically conductive itself. The mechanical flexibility of this type of electrode provides additional flexibility in the positioning of the discharge element with respect to handling different sheet sizes. Although it is preferred to arrange the discharge elements such that the end-portions are positioned just outside of the flipping volume, this type of mechanical flexible electrode does not disturb the formation of a straight stack when the end-portions are positioned slightly inside the flipping volume. If a sheet touches a small portion of such electrode it will flex automatically and continue its flipping movement almost undisturbed. The electrically conductive outer surface may comprise carbon or any other suitable conductive material.

In another embodiment of the device according to the present invention, the discharge element is moveably arranged, such that the lateral position with respect to the sheet is adaptable. By enabling a laterally adaptable positioning of the discharge element, in particular, the end-portions of the electrodes thereon, a variety of sheet sizes may be handled. It is preferred to arrange the end-portions of the electrodes just outside of the flipping volume in order not to disturb the flipping sheets' movement and to be close enough to function efficiently.

The adaptation of the lateral position may be manual or automated in accordance with a measurement or other electrical signal, for example a signal from a printer controller of a printer coupled to such a flipping device.

In another embodiment of the device according to the present invention, the sheet flipping device further comprises a module for generating an airflow in the direction of the flipping sheets' movement such that the flipping of the sheet is assisted during at least a part of the flipping movement of the sheet. A module for generating an airflow may, for example, comprise a ventilator that blows in the direction of the sheet's flipping movement, or a suction device that sucks the sheet during at least a part of the flipping movement in the direction of flipping. A combination of sucking and blowing or other modules for generating airflow are also implementable.

BRIEF DESCRIPTION OF THE DRAWINGS

The present invention will now be explained with reference to the following figures, wherein.

DETAILED DESCRIPTION OF THE INVENTION

Figure 1:
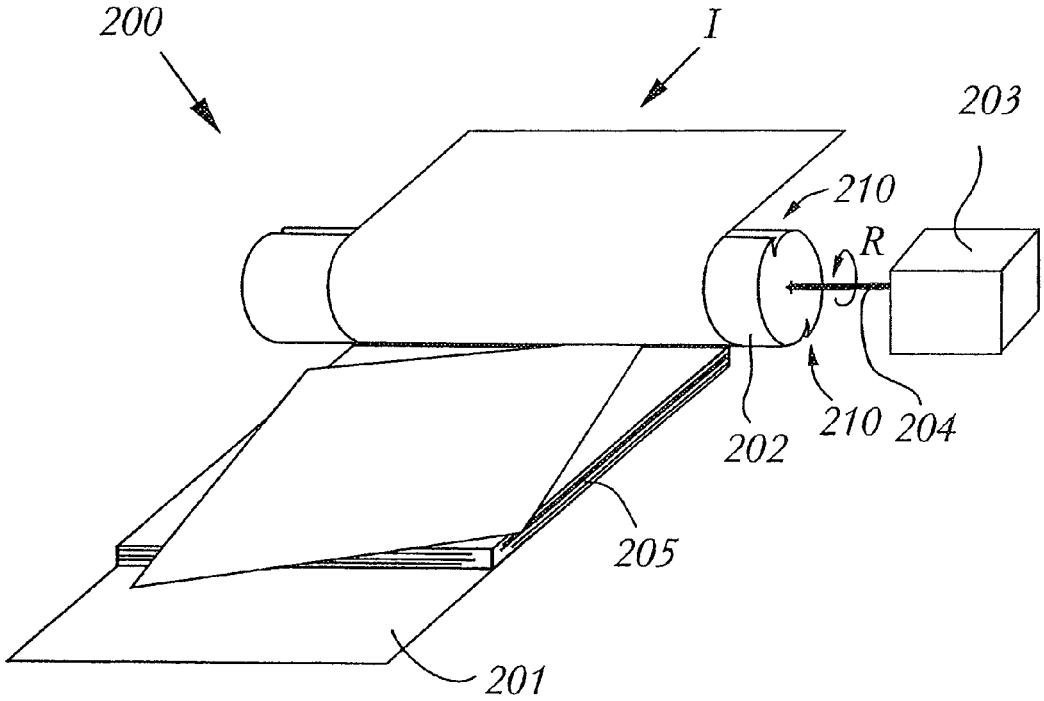
Figure 1 CONVENTIONAL ART
FIG. 1 is a schematic perspective view showing a sheet stacking device comprising a flipping device.

FIG. 1 is a schematic perspective view showing a sheet stacking device containing a flipping device. This sheet stacking device 200 comprises a receiving member 201 for receiving sheets to form a stack of sheets 205. The sheet stacking device further includes a rotatable flipping element, such as a flipping wheel 202. This flipping wheel has two slits 210 arranged along its circumference. These slits 210 are devised such that sheets which are fed towards the flipping wheel 202 in the input direction I are at least partly received by the slits 210. The flipping wheel 202 is rotatably driven by means of drive motor 203 and a coupled drive shaft 204. By rotating the flipping wheel 202 in rotational direction R, the sheets are flipped over and arranged on top of the receiving member 201 or a previously formed stack 205. The sheet stacking device has a relative high degree of erroneous formed stacks.

Figure 2:
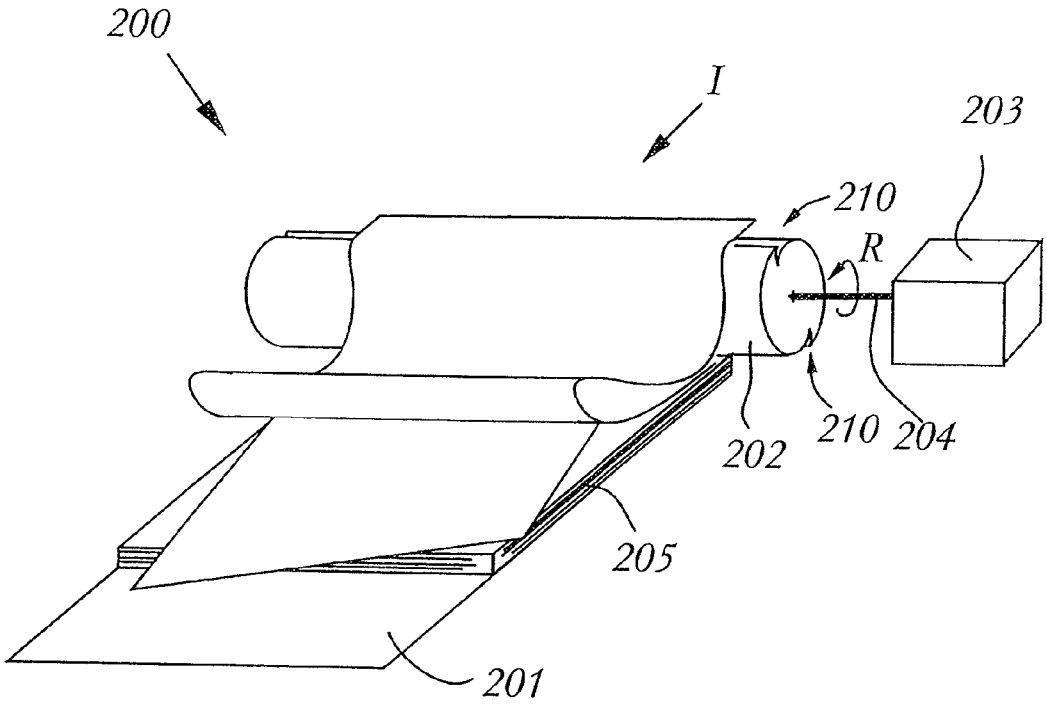
Figure 2 CONVENTIONAL ART
FIG. 2 is a schematic perspective view showing a sheet stacking device comprising a flipping device in operation.

FIG. 2 shows a problem during operation of the sheet stacking device resulting in an erroneous formed stack. The leading edge of the sheet has been received by the slit 210 and driven to be flipped. During the final part of the flipping of the sheet, the sheet has a problem when rolling out onto the top of the stack 205 formed on the receiving member 201. In particular floppy sheets with relatively low stiffness in the direction of rotation, tend to collapse onto themselves during flipping, preventing a smooth roll-out onto the top of the stack 205. This results in a less well-aligned stack of sheets and may even result in the blocking of the device.

Figure 3A:
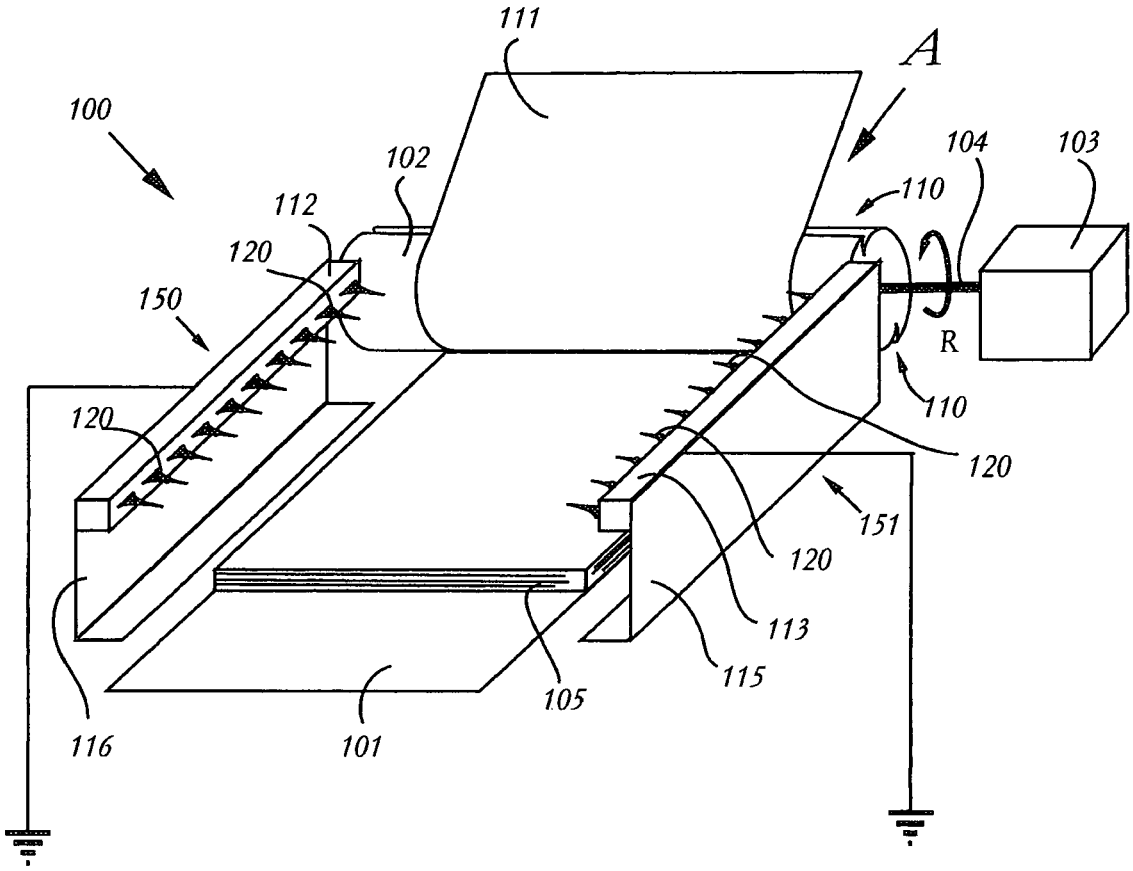
FIGS. 3A and 4A are schematic perspective views of embodiments of a sheet stacking device comprising a flipping device according to the invention.

FIG. 3A is a schematic, perspective view of an embodiment of a sheet stacking device utilizing the flipping device according to the present invention. The stacking device 100 comprises a rotatable sheet flipping wheel 102 as a sheet flipping element. This sheet flipping wheel 102 has two slits 110 at its circumference to accommodate at least a portion of an incoming sheet. The sheet flipping wheel 102 is connected to a drive motor 103 via a drive shaft 104. A sheet receiving member 101 is provided to accommodate a stack of sheets 105. The height of the sheet receiving member 101 relative to the flipping wheel 102 is adaptable to enable an enlarged sheet accommodation capacity while sheets are controllably released onto the top of the receiving member 101 or onto an already formed stack of sheets 105. Alternatively the sheet receiving member 101 may have a fixed height relative to the flipping wheel 102.

The sheet flipping device is further provided with two discharge elements 150, 151 arranged adjacent to the flipping volume. This flipping volume is the volume through which the sheet 111 is actually moved during its flipping movement, in operation from its initial position to its flipped position on top of the receiving member 101 or the previously formed stack 105. The discharge elements 150, 151 have bases 112, 113 extending in a direction substantially perpendicular to the direction of the axis of rotation of the flipping wheel 102. The discharge elements 150, 151 have multiple electrodes 120 arranged on the bases 112, 113 having an end portion extending in a direction towards the flipping volume. The discharge elements 150, 151 are mounted on an apparatus frame (not shown) via frame mounts 115, 116.

In operation an incoming sheet is fed towards the sheet flipping wheel 102 in direction A from a supply or any sheet processing unit (not shown). In the illustrated situation, the leading edge portion of sheet 111 is accommodated in slit 110 and rotated in the direction of rotation R by driving the driving motor 103 for approximately a half revolution. At this point, the leading edge portion of the sheet 111 is released from the slit 110 by means of an abutment (not shown) which is arranged between two segments of the flipping wheel 102. By rotating the flipping wheel 102 further, the sheet 111 will be released and accommodated on top of the previously formed stack 105 in a flipped orientation with respect to its original orientation.

The electrodes 120 of the discharge elements 150, 151 have a sharp end, pointing towards the flipping volume to enable a discharge during the flipping of a sheet 111. The electrodes 120 are electrically conductive. Electrically conductive electrodes 120 are electrically connected to the bases 112, 113. The bases 112, 113 are connected to earth potential. The discharge element 150, 151 is constructed as an integral element formed from a single workpiece, e.g., stainless steel or any other electrical conductive material but may alternatively also be constructed as a modular assembly wherein the electrodes 120 are individually mounted on the base 112, 113.

Figure 3B:
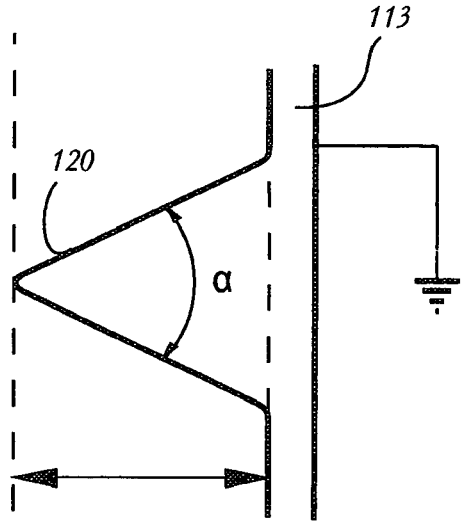
FIGS. 3B and 4B are schematic top view close-ups of electrodes for use in the embodiments of a sheet stacking device comprising a flipping device according to the invention.

FIG. 3B is a schematic top view close-up of an electrode for use in the sheet stacking device of FIG. 3A. The electrode 120 and base 113 are formed from a single piece of stainless steel by milling. The top angle a must be highly curved, such that it is sharp enough to enable a discharge, in this case smaller than 30°, but preferably less than 15°.

Figure 4A:
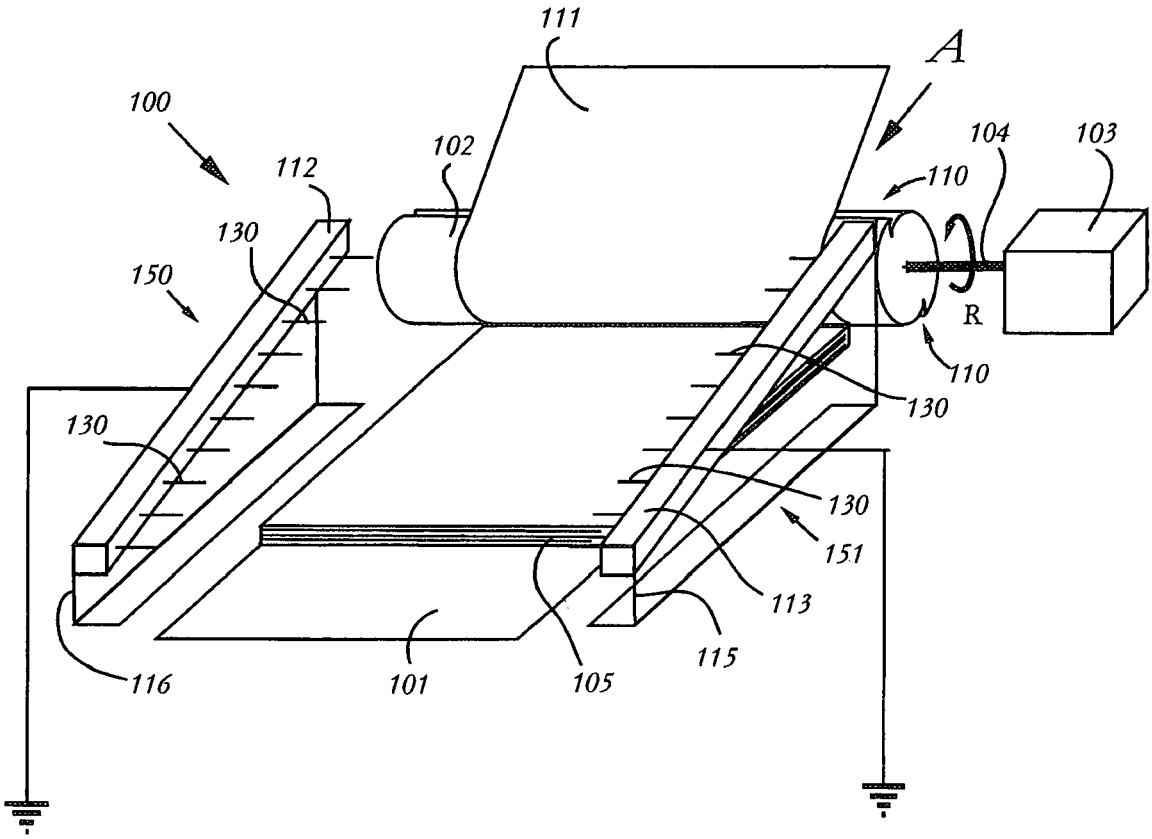

FIG. 4A is a schematic perspective view of an embodiment of a sheet stacking device comprising a flipping device according to the present invention. It generally equals the device as presented in FIG. 3, but in particular the discharge elements are implemented with fiber electrodes 130. The fiber electrodes 130 are mounted on the bases 112, 113 of the discharge elements 150, 160. Each fiber electrode 130 comprises a flexible fiber organ provided with a conductive outer surface. Fiber electrodes 130 may be mounted on the bases 112, 113 individually or in groups.

Figure 4B:
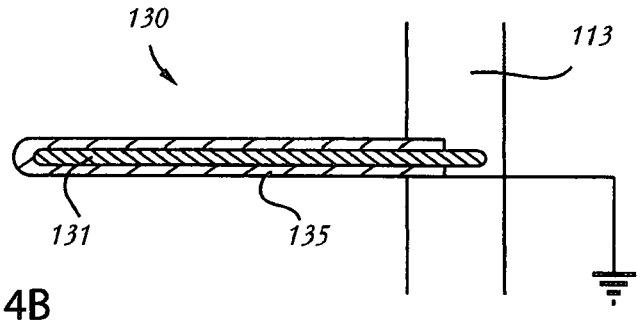

FIG. 4B is a schematic top view close-up of an electrode for use in the sheet stacking device of FIG. 4A. The fiber electrode 130 is mounted on base 113 by means of a fiber 131, which is anchored in the base 113. The flexible fiber 131 is provided with an electrically conductive surface layer 135. The electrically conductive outer surface 135 is connected to earth potential. In practise the fiber electrode 130 is taller than illustrated in FIG. 4B, similar to a flexible needle or hair-like object. The fiber electrode 130 is mounted individually on the base 113, by may alternatively be mounted in groups of clusters of fiber electrodes 130. In this case, the connection with earth potential may also be provided collectively.

Figure 5:
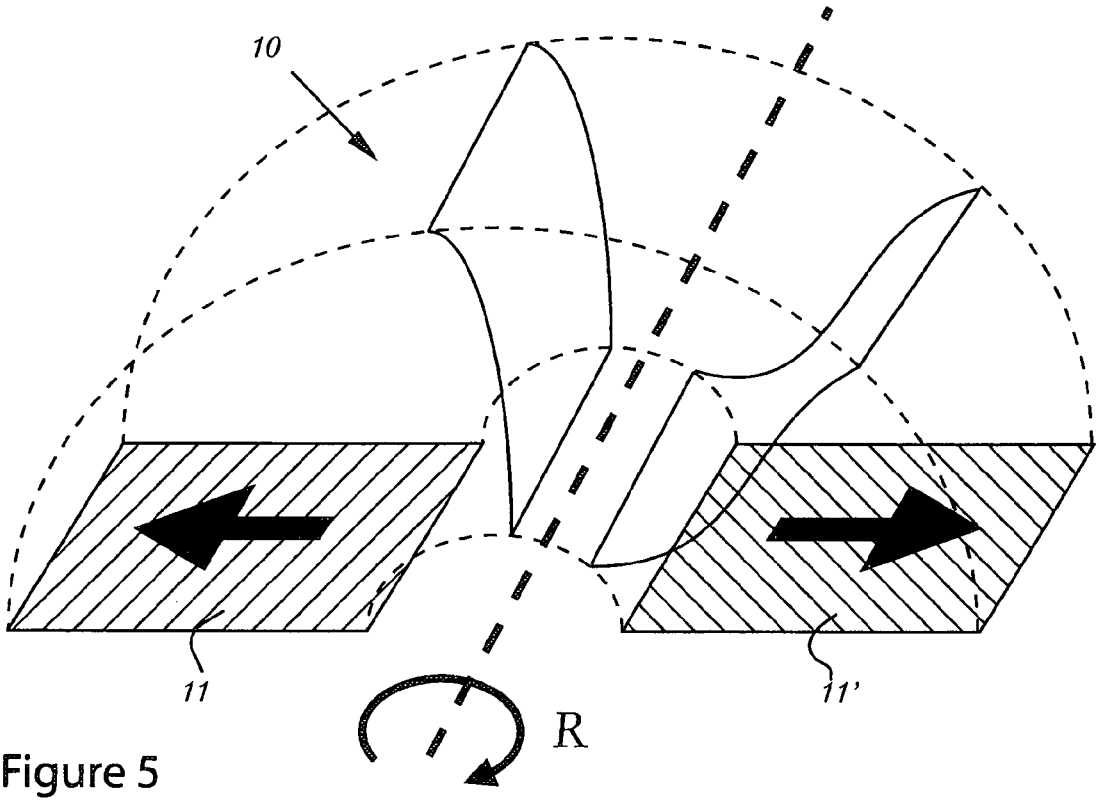
FIG. 5 is a schematic view showing a flipping sheet in the flipping volume.

FIG. 5 is a schematic view showing a flipping sheet in the flipping volume. A sheet 11 that is flipped using a sheet flipping device according to the present invention (not shown) is moved through a flipping volume 10. This flipping volume 10 is the volume through which the sheet 11 is actually moved during its flipping movement in operation from its initial position 11 to its flipped position 11'. The flipping element (not shown) flips the sheet 11 around its axis of rotation, indicated as the bold dashed line in the rotational direction R. The flipping volume 10 is spanned by the accumulated positions of the sheet 11 during its flipping movement towards position 11'. The flipping volume 10 is indicated by the dashed lined volume.

In the flipping device according to the present invention, the discharge elements are arranged adjacent to the flipping volume. In practise a variety of sheet sizes may be processed and stacked. Therefore the discharge elements are generally arranged adjacent to the flipping volume of the sheet size with the largest width. If the end portions of the electrodes are sharp enough, the electrodes will still enable a discharge to smaller sheet sizes.

Alternatively, the discharge elements may be arranged in a moveable fashion, such that the lateral position of the discharge elements may vary in dependence on the actual sheet size.

FIG. 6 is a schematic side view of multiple embodiments of a flipping device according to the present invention. FIG. 6A illustrates the embodiment wherein the discharge element 150 is arranged along a substantial length of the receiving member 101. This embodiment is further illustrated in FIG. 3.

Figure 6A:
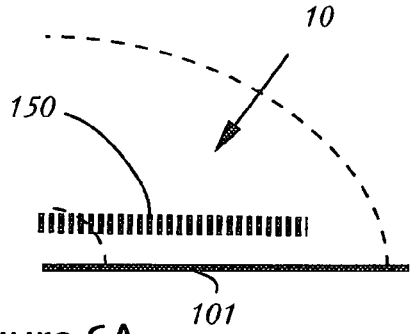
FIG. 6 is a schematic side view of multiple embodiments of a flipping device according to the invention.
Figure 6B:
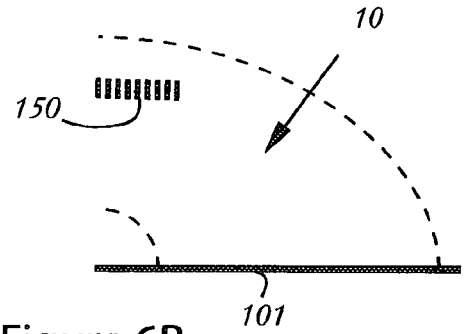

FIG. 6B illustrates the embodiment wherein the discharge element 150 is arranged on a relatively short stretch on a relatively high position with respect to the flipping volume 10.

Figure 6C:
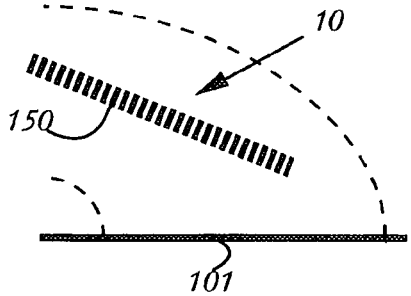
Figure 6D:
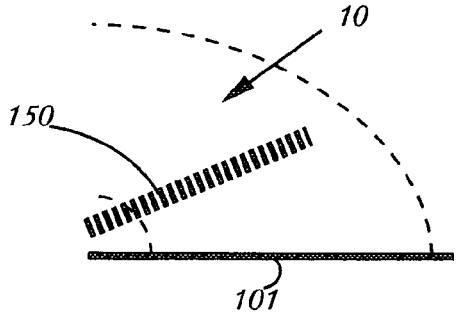

FIG. 6C illustrates the embodiment wherein the discharge element 150 is arranged along a substantial length of the receiving member 101 on a downward slope with respect to the receiving member 101. This embodiment is further illustrated in FIG. 4.

FIG. 6C illustrates the embodiment wherein the discharge element 150 is arranged along a substantial length of the receiving member 101 at an upward slope with respect to the receiving member 101.

The illustrated embodiments of FIG. 6 A-D may be implemented with any of the previously described electrodes. It will be clear for a person skilled in the art that any combination or iteration of the presented embodiments may produce a working embodiment.

End-portions of electrodes may extend slightly into the flipping volume 10 thereby slightly toughing the flipping sheets, but preferably the end-portions are arranged just outside and adjacent to the flipping volume.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A sheet flipping device defining a flipping volume which comprises:

a receiving member for receiving a sheet, a flipping element for flipping the sheet around an axis of rotation within the flipping volume onto the receiving member, a first discharge element disposed adjacent to a first side of the flipping volume and a second discharge element disposed adjacent to a second side of the flipping volume, the second side being opposite to the first side, wherein the first and second discharge elements have a base extending in a direction substantially perpendicular to the direction of the axis of rotation and are provided with multiple electrodes mounted on the base with an end portion extending in a direction towards the flipping volume.

2. The sheet flipping device according to claim 1, wherein each of the multiple electrodes has a sharp end pointing towards the flipping volume.

3. The sheet flipping device according to claim 2, wherein the sharp end of each of the multiple electrodes defines an angle of less than 30°.

4. The sheet flipping device according to claim 2, wherein each of the multiple electrodes has two sides defining an angle of less than 30°.

5. The sheet flipping device according to claim 1, wherein the discharge element is electrically connected to an earth potential.

6. The sheet flipping device according to claim 1, wherein said multiple electrodes comprise pin-electrodes.

7. The sheet flipping device according to claim 1, wherein each of said multiple electrodes comprises a fiber provided with a conductive outer surface.

8. The sheet flipping device according to claim 7, wherein the conductive outer surface comprises carbon.

9. The sheet flipping device according to claim 1, wherein the discharge element is laterally moveable with respect to the sheet.

10. A sheet stacking device containing the sheet flipping device of claim 1.

11. An image reproduction apparatus comprising the sheet stacking device of claim 10.

12. The sheet flipping device according to claim 1, wherein the discharge element is inclined relative to the receiving member.

13. The sheet flipping device according to claim 1, wherein the discharge element is arranged along a substantial length of the receiving member.

14. The sheet flipping device of claim 1, wherein the discharge element is disposed above the receiving member.

15. The sheet flipping device of claim 1, wherein the flipping element is a roller provided with a slit which extends along a surface of the roller substantially parallel to the rotational axis of the roller.

16. The sheet flipping device of claim 1, wherein the first and second discharge elements extend along lateral sides of the flipping volume from a top to a bottom of the sheet.

17. The sheet flipping device of claim 16, wherein the first and second discharge elements containing the multiple electrodes are disposed in a substantially common plane above the receiving member.

* * * * *